US007503638B2

(12) United States Patent
Sato et al.

(10) Patent No.: US 7,503,638 B2
(45) Date of Patent: Mar. 17, 2009

(54) INK JET PRINTING APPARATUS, AND DEVICE AND METHOD FOR RECOVERING EJECTION PERFORMANCE OF INK PRINTING APPARATUS

(75) Inventors: Kazuhiko Sato, Tokyo (JP); Taku Yokozawa, Yokohama (JP); Yuhei Oikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 11/360,569

(22) Filed: Feb. 24, 2006

(65) Prior Publication Data

US 2006/0197799 A1 Sep. 7, 2006

(30) Foreign Application Priority Data

Mar. 4, 2005 (JP) ..... 2005-061253

(51) Int. Cl.
*B41J 2/165* (2006.01)

(52) U.S. Cl. ..... 347/33; 347/22; 347/34

(58) Field of Classification Search ..... 347/22, 347/33, 34
See application file for complete search history.

(56) References Cited

U.S. PATENT DOCUMENTS 5,570,117 A * 10/1996 Karambelas et al. ..... 347/33
6,158,839 A * 12/2000 Fukushima et al. ..... 347/33
6,244,685 B1 * 6/2001 Yamada et al. ..... 347/33
2002/0130921 A1 * 9/2002 Anderson et al. ..... 347/33
2003/0063170 A1 * 4/2003 Umeyama et al. ..... 347/93
2005/0012797 A1 * 1/2005 Nagashima et al. ..... 347/100

FOREIGN PATENT DOCUMENTS

JP 2-095862 4/1990
JP 7-164643 6/1995

* cited by examiner

*Primary Examiner*—Manish S Shah
*Assistant Examiner*—Laura E Martin
(74) *Attorney, Agent, or Firm*—Fitzpatrick, Cella, Harper & Scinto

(57) ABSTRACT

An ink jet printing apparatus is capable of maintaining the ink ejection performance in good condition at all times even when a large number of ink droplets are used to form an image. To this end, the ink jet printing apparatus includes a wiping member to wipe off ink adhering to ejection ports and surrounding areas of the print head; and a control unit to count the number of ink droplets ejected from the ejection ports and change processing associated with a wiping-based recovery operation using the wiping member according to the counted number of ink droplets ejected.

10 Claims, 4 Drawing Sheets

INK JET PRINTING APPARATUS, AND DEVICE AND METHOD FOR RECOVERING EJECTION PERFORMANCE OF INK PRINTING APPARATUS

BACKGROUND OF THE INVENTION

1. Field of the Invention

The present invention relates to an ink jet printing apparatus that uses a print head with a plurality of ink ejection nozzles to form an image and to a recovery device and a recovery method for maintaining an ejection performance of the print head in good condition.

2. Description of the Related Art

A printing apparatus of an ink jet printing system that forms an image by ejecting ink droplets onto a print medium uses a print head having formed therein a plurality of minute ejection ports and ink paths communicating with them (all these are generally referred to as nozzles). In this ink jet printing apparatus, ink may become more viscous or solidify adhering to nozzles because of bubbles and dust entering from the ejection ports into the ink in the paths or because of evaporation of solvent contained in the ink. If this happens, the ejection performance of the print head degrades significantly. That is, problems arise with the print head, such as landing deviations of ejected ink droplets and a failure to eject ink droplets. To avoid such ejection performance degradations of the print head, a conventional practice involves refreshing ink in the nozzles to discharge viscous or solidified ink from the nozzles. This process is called an ejection performance recovery operation.

One form of the ejection performance recovery operation uses a cap capable of covering a face of the print head formed with ejection ports and a pump connected to the cap. In this configuration, the cap covers the ejection port surface of the print head and the pump generates a negative pressure in the cap to forcibly suck out ink from the nozzles of the print head. Thus, this ejection performance recovery operation is also called a suction-based recovery operation.

Another form of the ejection performance recovery operation involves driving ink ejection energy generation devices in the nozzles with the cap opposed to the ejection port surface of the print head. This causes viscous ink or ink containing bubbles and dust to be ejected into the cap, refreshing the ink in the nozzles.

The ink received during the ejection performance recovery operation into an ejection performance recovery device, including the cap, pump and waste ink tube communicating with these, is led toward a waste ink tank. This is accomplished by operating the pump with the cap open to the atmosphere, a so-called open suction operation.

There are other factors responsible for the deteriorated ink ejection performance, such as ink and paper dust adhering to the surroundings of the ejection ports. To remove these ejection failure factors, another ejection performance recovery operation is also performed which wipes the ejection port surface of the print head with a blade (referred to as a wiping-based recovery operation).

In this wiping-based recovery operation, viscous ink and dust may solidify and accumulate on the blade as a result of its wiping action. When the ink and dust solidify on the blade, the recovering capability of the blade deteriorates significantly. Thus a method has been proposed which ejects ink from the print head onto the blade to clear the blade of the viscous ink and dust (Japanese Patent Application Laid-open No. 7-164643 (1995)). Further, Japanese Patent Application Laid-open No. 2-095862 (1990) discloses a method of removing the ink sticking to the blade by performing a preliminary ejection while the blade is wiping. The preliminary ejection means an ink ejection, not contributing to the formation of an image, which is performed at the beginning of a printing operation to keep the ejection performance of the nozzles of the print head in good condition.

The printing apparatus at times ejects a large number of ink droplets and a large volume of ink as during the printing on a large area, continuous printing or high-duty printing. During such printing operations, ink easily remains on the ejection port surface of the print head and on the blade either in a solidified state or highly viscous state. The conventional techniques described above may not be able to remove sticking ink thoroughly from the ejection port surface of the print head.

More specifically, in the ink jet printing apparatus of Japanese Patent Application Laid-open Nos. 7-164643 (1995) and 2-095862 (1990), the recovery operation using the blade is always performed only a predetermined number of times. It may not be possible, therefore, to thoroughly remove the ink remaining on the ejection port surface or on the blade when the ink is solidified or viscous. Particularly when ink solids adhere to the blade, the blade with a degraded ink removing performance cannot remove ink from the ejection port surface of the print head satisfactorily.

As described above, the conventional techniques used in the above patent documents may not be able to keep the ink ejection performance of the print head in good condition at all times and thus cannot prevent an ejection failure of the print head or degradation of ink landing accuracy well.

SUMMARY OF THE INVENTION

An object of this invention is to provide an ink jet printing apparatus, an ejection performance recovery device and an ejection performance recovery method which can maintain a satisfactory ink ejection performance at all times even when the printing operation ejects a large volume of ink.

To achieve the above objective, the present invention has the following construction.

According to a first aspect, the present invention provides an ink jet printing apparatus to form an image by using a print head formed with a plurality of ejection ports, comprising: wiping-based recovery means for removing ink adhering to the ejection ports and surrounding areas of the print head by a wiping-based recovery operation; and control means for counting the number of ink droplets ejected from the ejection ports and changing processing associated with the wiping-based recovery operation according to the counted number of ejected ink droplets.

According to a second aspect, the present invention provides an ejection performance recovery device for recovering an ejection performance of a print head in an ink jet printing apparatus, wherein the ink jet printing apparatus forms an image by using the print head formed with a plurality of ejection ports, the ejection performance recovery device comprising: wiping-based recovery means for removing ink adhering to the ejection ports and surrounding areas of the print head by a wiping-based recovery operation; and control means for counting the number of ink droplets ejected from the ejection ports and changing processing associated with the wiping-based recovery operation according to the counted number of ejected ink droplets.

According to a third aspect, the present invention provides an ejection performance recovery method for maintaining an ejection performance of a print head in good condition in an ink jet printing apparatus, wherein the ink jet printing apparatus forms an image by using the print head formed with a plurality of ink ejection ports, the ejection performance recovery method comprising: a wiping-based recovery step for removing ink adhering to the ejection ports and surrounding areas of the print head by wiping-based recovery operation using a wiping member; and a control step for counting the number of ink droplets ejected from the ejection ports and changing processing associated with the wiping-based recovery operation according to the counted number of ejected ink droplets.

In this invention, the number of ink droplets ejected from the ejection ports is counted and the processing associated with the wiping-based recovery operation using the wiping member is changed according to the counted value. This reduces the amount of ink remaining on the ejection port face of the print head, keeping the ink ejection performance of the print head in good condition at all times. It is therefore possible to reduce the possibility of ejection failures of the print head and the ink droplet landing deviations and thereby stabilize a quality of image formed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, an embodiment of this invention will be described in detail by referring to the accompanying drawings.

Figure 1:
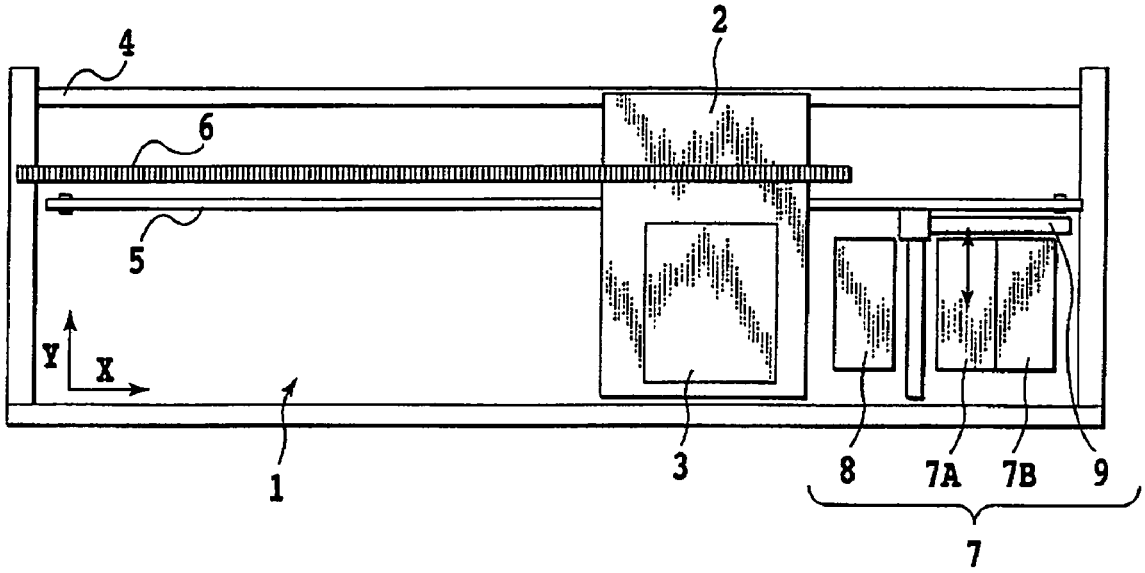
FIG. 1 is a plan view showing an ink jet printing apparatus as one embodiment of this invention.

FIG. 1 is a plan view showing an ink jet printing apparatus according to one embodiment of this invention.

In FIG. 1, reference number 1 represents a printing apparatus body equipped with various mechanical units including a print medium transfer unit (not shown). The printing apparatus body 1 and a control system described later which is mounted on the body together form an ink jet printing apparatus. The ink jet printing apparatus in this embodiment is of a serial type. The serial type printing apparatus performs the printing operation by intermittently transporting the print medium in a Y direction by the transport unit and at the same time moving the print head 3 in an X direction (main scan direction) perpendicular to the Y direction (sub-scan direction) or medium transport direction. The printing apparatus body 1 shown in FIG. 1 has an increased size in the X direction so that it can print on a relatively large print medium (e.g., A1 size).

In FIG. 1, denoted 2 is a carriage, on which a plurality (in this embodiment, six) of print heads 3 can be mounted. The carriage 2 together with the print heads 3 is reciprocally moved in a direction perpendicular to the print medium transport direction. That is, the carriage 2 is supported movable along a guide shaft 4 extending in the X direction and is secured to an endless belt 5 that moves almost parallel to the guide shaft 4. The endless belt 5 is reciprocated by a carriage motor (CR motor) to reciprocally move the carriage 2 in the X direction (main scan direction).

Figure 2:
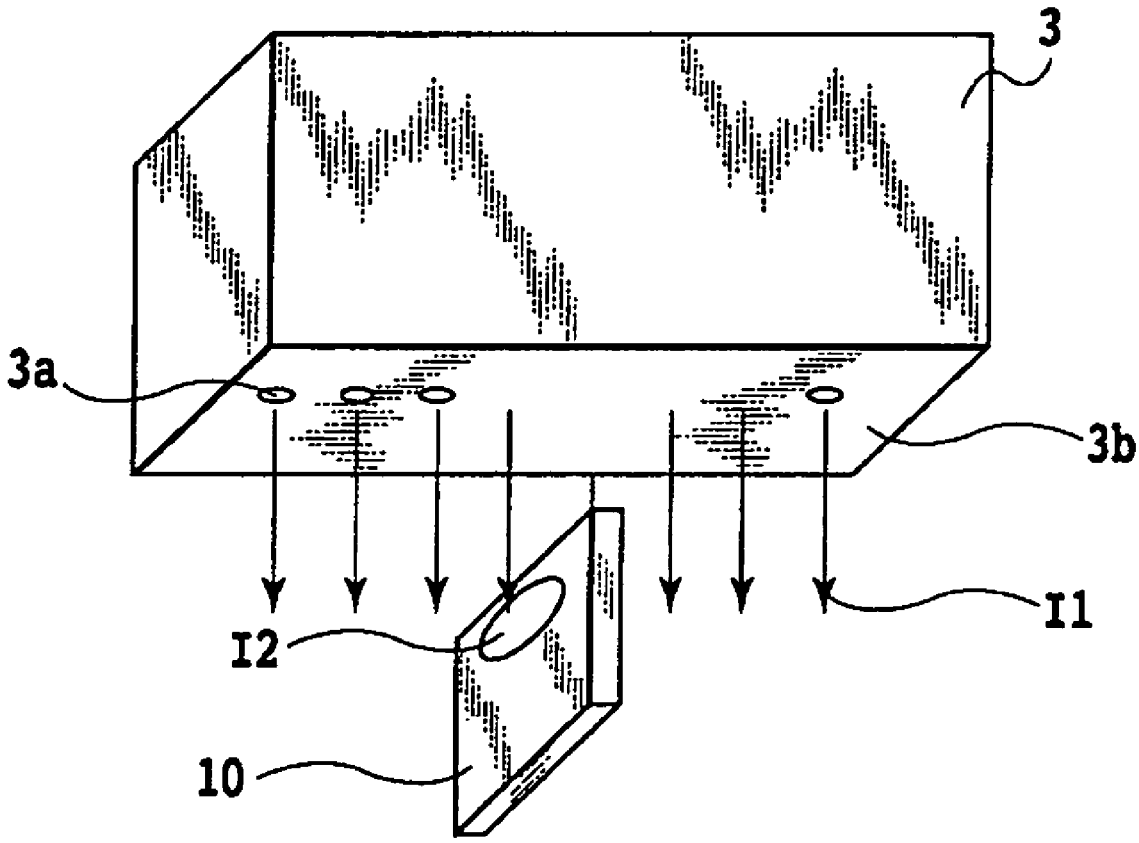
FIG. 2 is a perspective view schematically showing a print head and a blade in the embodiment of this invention.

Each of the print heads 3, as schematically shown in FIG. 2, is formed with a plurality of ejection ports 3*a* in an ejection port face 3*b*, a plurality of ink paths (not shown) corresponding to the individual ejection ports 3*a*, and a common liquid chamber (not shown) to supply ink to the plurality of ink paths. Each print head 3 of this embodiment has 1,280 ejection ports 3*a* arrayed in the sub-scan direction at a concentration of 1,200 dpi (dots/inch). In FIG. 2, I1 represents ink droplets ejected from the ejection ports 3*a* and I2 represents ink adhering to the blade 10.

In each of the ink paths in the print head 3 is installed an energy generation device to generate an ejection energy to eject ink from the associated ejection port 3*a*. As the energy generation device, an electrothermal transducer is used which locally heats ink to cause a film boiling and eject the ink by the pressure of the boiling. It is noted, however, that the present invention is not limited to this energy generation device but may also use an electromechanical transducer. In the description that follows, the ejection ports 3*a* and the ink paths together are called nozzles.

The six print heads mounted on the carriage 2 are supplied inks containing different colorants. In this embodiment, a total of six color inks—light cyan and light magenta, used to reduce a graininess of an image formed, as well as cyan, magenta, yellow and black—are supplied one to each print head 3.

Denoted 7 is an ejection performance recovery device to keep the print head ejection performance from individual ejection ports 3*a* in good condition. The ejection performance recovery device 7 is held at a predetermined position in the printing apparatus body 1. The ejection performance recovery device 7 includes suction-based recovery mechanisms 7A, 7B (described later), a wiping-based recovery mechanism 9, a raise/lower mechanism (not shown) to vertically move these mechanisms up or down, and a preliminary ejected ink receiving container 8.

The suction-based recovery mechanisms 7A, 7B perform a suction-based recovery operation, one form of the ejection performance recovery operation. The suction-based recovery operation forcibly sucks out ink from a plurality of nozzles of the print head to replace ink in the nozzles with one suited for ejection from the nozzles. More specifically, the suction-based recovery mechanisms 7A, 7B cover the ejection port face 3*b* (see FIG. 2) with a cap and generate a negative pressure in the cap by the pump communicating with the cap to force ink out of the ejection ports 3*a* by the negative pressure. The suction-based recovery mechanisms 7A, 7B perform the suction-based recovery operation on each of three print heads 3.

Another form of ejection performance recovery operation is a preliminary ejection. The preliminary ejection does not contribute to image forming and ejects ink into the ink receiving container 8 to keep the ink in the nozzles of the print head in a condition suited for ejection. The preliminary ejection is performed mainly at the start or end of the printing operation. It may also be performed at predetermined intervals during the printing operation.

The wiping-based recovery mechanism 9 performs a wiping operation on the ejection port surface of each print head 3 and is fixed at a position vertically facing the moving path of the print heads 3. The wiping-based recovery mechanism 9, as shown in FIG. 2, has a wiping member (blade) 10 arranged along a plane almost perpendicular to the ejection port surface of the print heads 3. Further, the wiping-based recovery mechanism 9 also has a blade moving mechanism, not shown, that moves the blade 10 in the direction of array of the ejection ports of the print heads 3 (Y direction).

Figure 3:
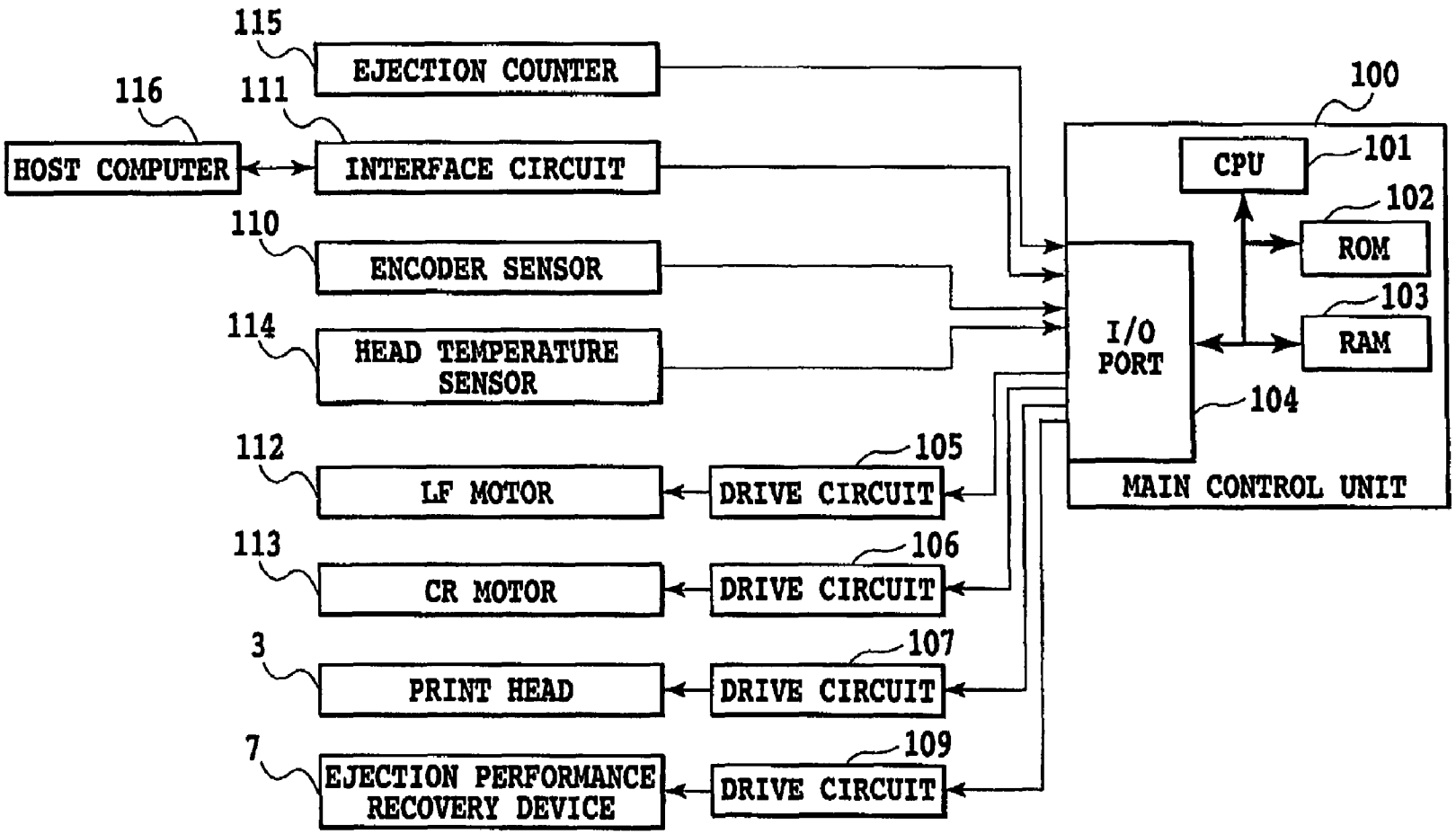
FIG. 3 is a block diagram showing an outline configuration of a control system in the embodiment of this invention.

FIG. 3 is a block diagram showing a configuration of a control system (control means) mounted on the body 1 of the ink jet printing apparatus in this embodiment. In FIG. 3, denoted 100 is a main control unit, which has CPU 101, ROM 102, RAM 103 and input/output port 104. The CPU 101 executes processing such as calculation, control, decision making and setting. The ROM 102 stores control programs to be executed by the CPU 101. The RAM 103 is used as a buffer storing binary print data representing ink ejection/non-ejection and as a work area by the CPU 101 for processing.

To the input/output port 104 are connected drive circuits 105, 106, 107, 109 for a transport motor (LF motor) 112 in the transport unit, the carriage motor (CR motor) 113, the print head 3 and the ejection performance recovery device 7. Also connected to the input/output port 104 are sensors, including a head temperature sensor (head temperature detection means) for detecting a temperature of the print head and an encoder sensor 110 secured to the carriage 2. The main control unit 100 is connected through an interface circuit 111 to a host computer 116.

Denoted 115 is an ejection counter that counts the number of ink droplets ejected from the print head. The ejection counter 115 counts for each print head the number of ink ejection data of the binary print data mapped in the buffer in the RAM 103 to count the number of ink droplets ejected. When the count value exceeds a predetermined threshold, the main control unit 100 operates the wiping mechanism 9 in the ejection performance recovery device 7 through the drive circuit 109.

Next, the printing operation and the blade-based recovery operation executed by the ink jet printing apparatus of the above construction will be explained.

First, an outline of the printing operation is explained.

When the print data is received from the host computer 116 through the interface, the print data is mapped in the buffer of the RAM 103. When a printing operation is instructed, the transport unit (not shown) is operated to feed the print medium to a position facing the print heads 3. Then, the carriage 2 is moved along the guide shaft 4 in the main scan direction (X direction). As the carriage 2 is moved, the print heads 3 eject ink droplets to form one band of image on the print medium. After this, the print medium is fed a distance of one band in a direction perpendicular to the carriage movement (in a sub-scan direction) by the transport unit. By repeating the above operations, an intended image is formed on the print medium.

The position of the carriage 2 is detected by the main control unit 100 counting pulse signals output from the encoder sensor 110 as the carriage 2 moves. That is, the encoder sensor 110 detects marks formed at predetermined intervals on an encoder film 6 (see FIG. 1) arranged along the main scan direction and outputs pulse signals to the main control unit 100. The main control unit 100 counts the pulse signals to detect the position of the carriage 2. The moving of the carriage 2 to the home position and other positions is performed based on the signal from the encoder sensor 110.

Next, the wiping-based recovery operation performed in this embodiment will be explained.

In executing the wiping-based recovery operation, the carriage 2 is moved until the ejection port surface 3*b* of the print heads 3 opposes the wiping mechanism 9, at which time ink is ejected from the ejection ports 3*a*. After this, the wiping mechanism 9 is moved up by the raise/lower mechanism of the ejection performance recovery device 7 until the blade 10 contacts the ejection port surface 3*b* of the print heads. Then, the wiping mechanism 9 moves the blade 10 in the nozzle array direction of the print heads 3 (Y direction) to wipe off dust and ink adhering to the ejection port face 3*b*. At this time, the ink that was sticking to the ejection port surface 3*b* now adheres to the blade 10. This wiping-based recovery operation is performed when the number of ink droplets for printing has exceeded a predetermined threshold, as described above. Not only when the threshold is exceeded, the wiping-based recovery operation may also be executed at a preset timing, for example, after the suction-based recovery operation or the preliminary ejection operation has been executed or after a predetermined number of print medium sheets has been printed.

In the conventional wiping-based recovery operation, the number of wiping actions performed on the ejection port surface 3*b* and the number of cleaning ejections to the blade 10 in one recovery operation are fixed. So, when the amount of ink adhering to the ejection port surface 3*b* and the blade 10 is less than a predetermined volume, the sticking ink may be able to be removed properly from the ejection port surface 3*b*. However, if the number of ink droplets ejected from the print head is large, as when the printing operation is done at a high print duty or in a large print area, the amount of ink or ink mist remaining on the ejection port surface 3*b* during the printing operation increases. Hence, a large volume of ink adheres to the ejection port surface 3*b* and the blade 10, making it difficult for the conventional wiping-based recovery operation to remove the ink well off the ejection port surface 3*b*. Although the ink may be able to be removed properly by setting the number of wiping actions based on the maximum number of ink ejections from the print head, i.e., the maximum volume of ink that will adhere to the ejection port surface, this method has a problem that an excess number of wiping actions will be executed when the number of ink ejections is small. This raises another problem of a reduced printing speed and an increased wear of the ejection port surface and blade.

If the ejection operation is at rest for a long period of time or if the temperature of the ejection port surface 3*b* rises because of ink ejection, the ink adhering to the blade 10 and the ejection port surface 3*b* becomes more viscous or solidifies, sticking to them. This phenomenon is known to become conspicuous particularly when an ink with a property of easily becoming viscous, such as matte black ink, is used. When the ink adhering to the ejection port surface 3*b* and blade 10 is in a viscous or solidified state, the removal of ink by the blade 10 becomes even more difficult.

Hence, in this embodiment the number of ink ejections performed after the previous wiping operation has been done until the current wiping operation is executed is counted by the ejection counter 115. Based on the count value, the number of wiping actions of the blade 10 and the number of ink ejections to the blade 10 are controlled.

That is, the CPU 101 of the main control unit 100 checks whether the count value received from the ejection counter 115 is in excess of a threshold. If the count value is less than the threshold, the ink ejection to the blade 10 is performed a first preset number of times for ejection and then the wiping action of the blade 10 is performed a first preset number of times for wiping. If the count value is greater than the threshold, the ink ejection to the blade 10 is performed a second number of times for ejection, which is greater than the first ejection number, and then the wiping action of the blade 10 is executed a second number of times for wiping, which is greater than the first wiping number.

As described above, in this embodiment the number of ink ejections to the blade 10 and also the number of wiping actions of the blade 10 are, respectively, set to one of two different levels according to whether or not the ink droplets ejected for printing exceeds the threshold. Thus, if the number of ink droplets ejected for printing is large and a large amount of viscous ink adheres to the blade 10, the wiping-based recovery operation can be performed in condition that viscous ink on the blade 10 is dissolved. Since the wiping action of the blade 10 is performed a large number of times, the viscous ink on the ejection port surface 3*b* as well as on the blade 10 can be removed reliably. Further, if the number of ink droplets ejected for printing is less than the threshold, an excess wiping operation can be prevented, alleviating the wear of the ejection port surface 3*b* of the print head 3 and the blade 10.

Further, during the wiping-based recovery operation this embodiment uses a light cyan ink or cyan ink, which tends to become viscous less easily than other inks, facilitating the dissolving or washing away of the adhering ink from the blade 10 and ejection port surface. This makes the subsequent wiping-based recovery operations for the print head more reliable.

Now, the procedure of the ejection performance recovery operation executed in this embodiment will be explained in detail by referring to the flow chart of FIG. 4.

Figure 4:
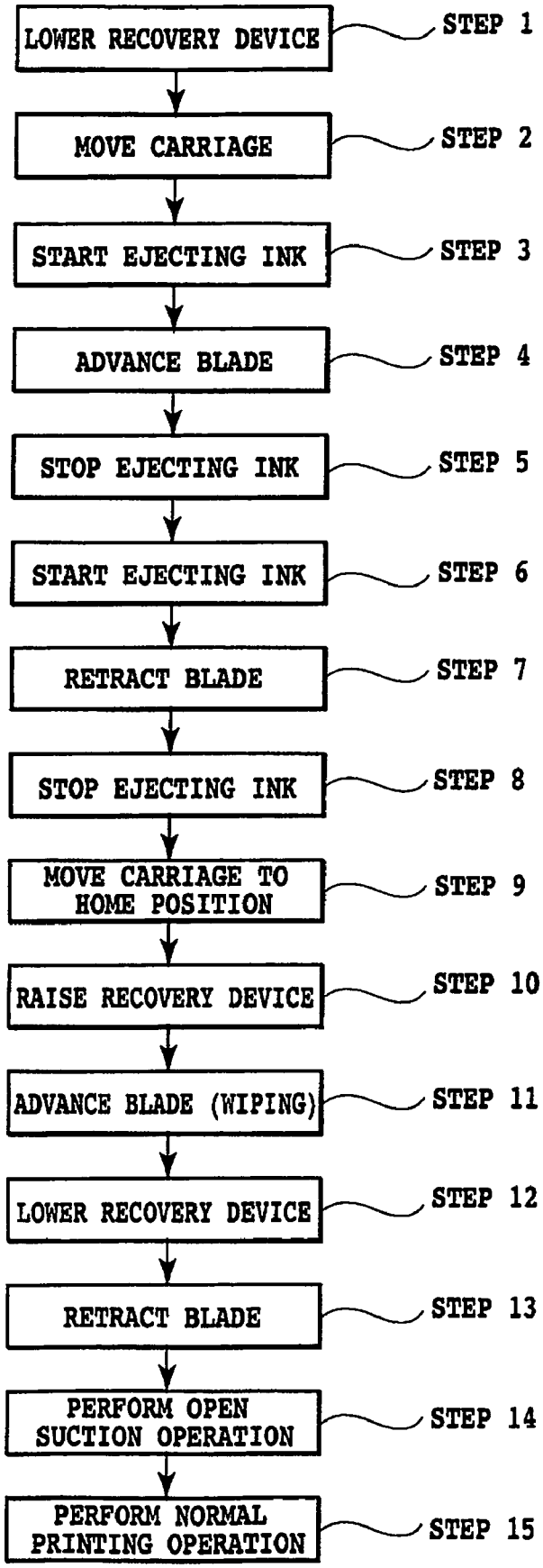
FIG. 4 is a flow chart showing an example of an ejection performance recovery operation executed in the embodiment of this invention.

The flow chart of FIG. 4 shows a recovery procedure in this embodiment.

This procedure represents an example recovery operation performed from when the ejection port surface 3*b* of the print heads 3 is covered with a cap until the printing operation is started.

First, the recovery device is moved down by the raise/lower mechanism (step 1). At this time, the blade is located at a position where it can be advanced and retracted in the wiping direction (Y direction) by the operation of the wiping mechanism without contacting the ejection port surface 3*b* of the print heads 3.

There is a possibility that a viscous or solidified ink may be adhering to a part of the blade 10 that performed repetitive wiping actions during the previous recovery operation. So, the carriage 2 and the blade 10 are moved to a position where a light cyan ink or cyan ink with a low viscosity can be directly ejected to the viscous or solidified ink on the blade 10 (step 2).

Next, the blade 10 is advanced by the wiping mechanism as the print heads 3 eject the light cyan ink or cyan ink toward the blade 10. Then, the light cyan ink or cyan ink is directly ejected to the blade 10 (step 3, 4, 5). After this, as the blade 10 begins to retract, the light cyan ink or cyan ink is again ejected directly to the blade 10 (step 6, 7, 8).

The number of ink ejections to the blade 10 is changed according to the decision as to whether the count value received from the ejection counter 115 is in excess of the threshold. That is, the ink ejection is executed the first or second number of times for ejection.

Next, the carriage 2 is returned to the home position (step 9) and then the ejection performance recovery device 7 is moved up by the raise/lower mechanism (step 10). Here, the blade 10 is moved forward and backward to perform the wiping-based recovery operation (step 11). The number of wiping actions performed in the wiping-based recovery operation is changed according to whether or not the count value of the ejection counter 115 is higher than the threshold. That is, when the count value is less than the threshold, the wiping action is performed the first number of times for wiping. When it exceeds the threshold, the wiping action of the blade 10 is performed the second number of times for wiping.

With the wiping operation completed, the ejection performance recovery device 7 is lowered (step 12), the blade 10 is retracted to its original position (step 13) and the open suction operation is performed (step 14). The open suction operation is intended to move the ink received in the cap, pump and waste ink tube communicating with these into a waste ink tank (not shown). This open suction operation is done by operating the pump with the cap open to the atmosphere. After the open suction operation is finished, the normal printing operation is started (step 15).

In the above embodiment, an example case has been described in which a decision is made as to whether or not the number of ink ejections has exceeded the threshold and in which the number of wiping actions and the number of ink ejections to the blade 10 are both changed according to the decision made. Depending on the condition of use of the device or on the environment of use, however, only the number of wiping actions or only the number of ink ejections to the blade 10 may be changed based on the result of the above decision. In this case also, compared with the conventional method, improvement in a recovery performance can be expected.

Further, in the above example the number of wiping actions and/or the number of cleaning ink ejections to the blade 10 are each changed between two different levels. The number of wiping actions and/or the number of cleaning ink ejections may also be changed between three or more levels or continuously according to the number of ink droplets ejected for printing. Further, it is also possible to change the number of wiping actions and/or the number of cleaning ink ejections to the blade 10 by taking into account not only the number of ink droplets ejected for printing but also a temperature of the print heads or a viscosity of the inks used. In this embodiment, the ink ejection for cleaning is performed as the blade is moved in both of two opposite directions, forward and backward, in step 4 and 7. However, if the viscous ink adhering to the blade can be dissolved by the ink ejection during the blade movement in one direction only, the ink ejection for dissolving the viscous ink may be performed only when the blade is moved in one direction.

Further, while in the above embodiment the ejection performance recovery device has the raise/lower mechanism, this invention can also be applied to devices with no raise/lower mechanism.

Next, a result of test will be described below. In the test, a comparison was made of an ink ejection accuracy between example cases 1, 2, that execute the ejection performance recovery operation in the above embodiment, and a reference case that executes the conventional recovery operation.

(Reference Case)

In the reference case the ink jet printing apparatus performed the recovery operation under the following conditions:

A) Ink ejection to a blade

Not performed

B) Number of wiping actions

Fixed regardless of the number of ink droplets ejected for printing (1 wiping action)

(Case 1)

In the example case 1 the ink jet printing apparatus performed the recovery operation under the following conditions:

(A) ink ejection to a blade a1: kind of inks ejected

Cyan ink and light cyan ink a2: Number of ink ejections to the blade for each ink when the number of printing ink droplets is less than the threshold 50 ink ejections (per nozzle)

a3: Number of ink ejections to the blade for each ink when the number of printing ink droplets is greater than the threshold 100 ink ejections (per nozzle)

(B) Number of Wiping Actions b1: When the number of printing ink droplets is less than the threshold Before printing: 1 wiping action After printing: 1 wiping action b2: When the number of printing ink droplets is greater than the threshold Before printing: 1 wiping action After printing: 2 wiping actions (Case 2)

In the example case 2 the ink jet printing apparatus performed the recovery operation under the following conditions:

(A) Kind of Ink Ejection to a Blade a1: Cleaning inks ejected

Cyan ink and light cyan ink a2: Number of cleaning ejections to the blade for each ink when the number of printing ink droplets is less than the threshold 50 ink ejections (per nozzle)

a3: Number of ink ejections to the blade for each ink when the number of printing ink droplets is greater than the threshold 100 cleaning ejections (per nozzle)

(B) Number of Wiping Actions b1: When the number of printing ink droplets is less than the threshold Before printing: 1 wiping action After printing: 1 wiping action b2: When the number of printing ink droplets is greater than the threshold Before printing: 1 wiping action After printing: 4 wiping actions The printing operations in the above cases 1, 2 and the reference case were performed under the following conditions.

A solid image with a 20% print duty for each color is formed on 1,000 sheets of a print medium of a size 1030 mm×100 mm (number of passes: 6; carriage speed: 33.3 inches/sec). In this printing operation, a predetermined pattern is output every 200 sheets (number of passes: 1; carriage speed: 18.4 inches/sec).

Based on the above pattern, measurements were taken of position differences in the media transport direction between target landing positions of ejected ink droplets and their actual landing positions to determine a variation, or standard deviation, of Y-direction landing position differences (referred to as a Y-direction deflection). Then, using the standard deviations, the landing accuracies of the case 1 and case 2 were compared to the landing accuracy of the reference case. The Y-direction deflection, σ(μm), is given by the following equation.

$$\sigma = \sqrt{\frac{\sum_{i}^{n} (Y_i - \overline{Y})^2}{n}}$$

In the above equation, n is the number of dots measured and $Y_i$ is a Y-direction position difference between an i-th dot and its target position.

$\overline{Y}$ is an average of Y-direction position differences for all dots. The measurements were taken at a temperature of 25 degrees C. and a humidity of 40%.

The print head mounted six color inks, cyan, magenta, yellow, light cyan, light magenta and matte black. The pattern used for the measurements of Y-direction positional differences was printed with a matte black ink, which has been experimentally confirmed to have a higher viscosity and a greater tendency to deviate from target landing positions than other color inks.

Table 1 shows the Y-direction deflections (μm) as related to the number of sheets printed, for the reference case and for the case 1 and case 2 of this invention.

TABLE 1

| | | Number of printed sheets | | | | | |
|---|---|---|---|---|---|---|---|
| | | 1 | 200 | 400 | 600 | 800 | 1000 |
| Y-direction landing position differences | Reference | 5 | 28 | 32 | 37 | 45 | 58 |
| | Case 1 | 5.5 | 6 | 6.5 | 6 | 6 | 6.5 |
| | Case 2 | 5 | 6 | 6 | 7 | 6 | 6 |

As shown in the above table, the Y-direction deflection (μm) in the reference case began to be noticeable 200 sheets after the printing operation was started and reached as large as about 60 μm after 1,000 sheets were printed. This level of Y-direction deflection is enough to be recognized by the user as a white line on a printed image, significantly degrading the image quality.

The Y-direction deflections (μm) in the case 1 and case 2 of this invention remained stably below 10 μm up to 1,000 sheets after the printing operation was started. This level of Y-direction deflection is not large enough to be recognized by the user in the printed image, and therefore no image quality degradation results. It follows therefore that the inks can be removed properly from the ejection port surface 3*b* in the case 1 and case 2.

This invention can be applied to any devices using a variety of print mediums, such as paper, cloth, leather, nonwoven cloth, OHP sheets and even metal sheets. More specifically, the applicable devices include office equipment such as printers, copying machines and facsimile machines, and also industrial manufacturing equipment. Furthermore, this invention is particularly effectively applied to devices that print on large-sized print mediums at high speed.

The present invention has been described in detail with respect to preferred embodiments, and it will now be apparent from the foregoing to those skilled in the art that changes and modifications may be made without departing from the invention in its broader aspects, and it is the intention, therefore that the appended claims cover all such changes and modifications as fall within the true spirit of the invention.

This application claims priority from Japanese Patent Application No. 2005-061253 filed Mar. 4, 2005, which is hereby incorporated by reference herein.

What is claimed is:

1. An ink jet printing apparatus that forms an image by using a print head having a plurality of ejection ports, comprising:

a wiping member that removes ink adhered around the ejection ports;

dissolving means that dissolves ink adhered to the wiping member by ejecting predetermined ink to the wiping member;

counting means that counts a number of ejections of ink ejected from the ink ejection ports; and control means that controls the dissolving means so that a number of ejections of the predetermined ink ejected by the dissolving means in a case where the number counted by the counting means is greater than or equal to a threshold is increased to be greater than a number of ejections of the predetermined ink ejected by the dissolving means in a case where the number counted by the counting means is less than the threshold.

2. An ink jet printing apparatus according to claim 1, wherein the predetermined ink is ink in which viscosity does not increase easily.

3. An ink jet printing apparatus according to claim 1, wherein the predetermined ink is light cyan ink.

4. An ink jet printing apparatus according to claim 1, wherein the dissolving means ejects a single or a plurality of kinds of ink from the print head to the wiping member.

5. An ink jet printing apparatus according to claim 1, wherein the dissolving means ejects the ink from the print head to the wiping member in synchronism with a sliding motion of the wiping member on an ejection port face of the print head.

6. An ink jet printing apparatus that forms an image by using a print head having a plurality of ejection ports, comprising:

a wiping member that removes ink adhered around the ejection ports;

dissolving means that dissolves ink adhered to the wiping member by applying a predetermined liquid to the wiping member;

counting means that counts a number of ejections of ink ejected from the ink ejection ports; and control means that changes an amount of the predetermined liquid to be applied by the dissolving means according to the ejection number counted by the counting means.

7. An ejection performance recovery device for recovering an ejection performance of a print head in an ink jet printing apparatus, wherein the ink jet printing apparatus forms an image by using a print head having a plurality of ejection ports, the ejection performance recovery device comprising:

a wiping member that removes ink adhered around the ejection ports;

dissolving means that dissolves ink adhered to the wiping member by ejecting predetermined ink to the wiping member;

counting means that counts a number of ejections of ink ejected from the ink ejection ports; and control means that controls the dissolving means so that a number of ejections of the predetermined ink ejected by the dissolving means in a case where the number counted by the counting means is greater than or equal to a threshold is increased to be greater than a number of ejections of the predetermined ink ejected by the dissolving means in a case where the number counted by the counting means is less than the threshold.

8. An ejection performance recovery method for recovering an ejection performance of a print head in an ink jet printing apparatus, wherein the ink jet printing apparatus forms an image by using a print head having a plurality of ejection ports, the ejection performance recovery method comprising:

a wiping step of removing ink adhered around the ejection ports by using a wiping member;

a dissolving step of dissolving ink adhered to the wiping member by ejecting predetermined ink to the wiping member;

a counting step of counting a number of ejections of ink ejected from the ink ejection ports; and a control step of controlling the dissolving step so that a number of ejections of the predetermined ink ejected in the dissolving step in a case where the number counted in the counting step is greater than or equal to a threshold is increased to be greater than a number of ejections of the predetermined ink ejected in the dissolving step in the case where the number counted in the counting step is less than the threshold.

9. An ejection performance recovery device for recovering an ejection performance of a print head in an ink jet printing apparatus, wherein the ink jet printing apparatus forms an image by using a print head having a plurality of ejection ports, the ejection performance recovery device comprising:

a wiping member that removes ink adhered around the ejection ports;

dissolving means that dissolves the ink adhered to the wiping member by applying a predetermined liquid to the wiping member;

counting means that counts a number of ejections of ink from the ink ejection ports; and control means that changes an amount of the predetermined liquid to be applied by the dissolving means according to the ejection number counted by the counting means.

10. An ejection performance recovery method for recovering an ejection performance of a print head in an ink jet printing apparatus, wherein the ink jet printing apparatus forms an image by using a print head having a plurality of ejection ports, the ejection performance recovery method comprising:

a wiping step of removing ink adhered around the ejection ports by using a wiping member;

a dissolving step of dissolving ink adhered to the wiping member by applying a predetermined liquid to the wiping member;

a counting step of counting a number of ejections of ink ejected from the ink ejection ports; and a control step of changing an amount of the predetermined liquid to be applied in the dissolving step according to the ejection number counted in the counting step.

* * * * *